US012102208B2

(12) United States Patent
Berhault et al.

(10) Patent No.: US 12,102,208 B2
(45) Date of Patent: Oct. 1, 2024

(54) BRUSH FOR APPLYING A PRODUCT TO THE EYELASHES AND/OR EYEBROWS

(71) Applicant: L'OREAL, Paris (FR)

(72) Inventors: Alain Berhault, Clichy (FR); Camille Schreiber, Clichy (FR); Audrey Thenin, Clichy (FR); Eric Caulier, Clichy (FR)

(73) Assignee: L'OREAL, Paris (FR)

( * ) Notice: Subject to any disclaimer, the term of this patent is extended or adjusted under 35 U.S.C. 154(b) by 604 days.

(21) Appl. No.: 16/347,998

(22) PCT Filed: Nov. 13, 2017

(86) PCT No.: PCT/EP2017/079041
§ 371 (c)(1),
(2) Date: May 7, 2019

(87) PCT Pub. No.: WO2018/091404
PCT Pub. Date: May 24, 2018

(65) Prior Publication Data

US 2019/0289982 A1 Sep. 26, 2019

(30) Foreign Application Priority Data

Nov. 15, 2016 (FR) ..... 1661019

(51) Int. Cl.
*A46B 9/02* (2006.01)
*A45D 34/04* (2006.01)
*A45D 40/26* (2006.01)

(52) U.S. Cl.
CPC ..... *A45D 34/045* (2013.01); *A45D 40/262* (2013.01); *A45D 40/265* (2013.01); *A46B 9/021* (2013.01); *A46B 2200/1053* (2013.01)

(58) Field of Classification Search
CPC .. A45D 34/045; A45D 40/265; A45D 40/262; A45D 34/042; A45D 34/043;
(Continued)

(56) References Cited

U.S. PATENT DOCUMENTS 4,898,193 A * 2/1990 Gueret ..... A45D 40/265 15/207.2
5,542,439 A * 8/1996 Gueret ..... A46B 3/18 15/207.2

(Continued)

FOREIGN PATENT DOCUMENTS

EP 0663161 A1 7/1995
EP 0792603 A1 9/1997

(Continued)

OTHER PUBLICATIONS

Berhault A, "FR_3013569_A1_I_abstract_translated" (Year: 2015).*

(Continued)

*Primary Examiner* — Jacqueline T Johanas
*Assistant Examiner* — Holly T. To
(74) *Attorney, Agent, or Firm* — Shumaker, Loop & Kendrick, LLP

(57) ABSTRACT

A brush for applying a product to the eyelashes and/or eyebrows, including a core, in particular a twisted core, that extends along a longitudinal axis, and bristles that are held by the core in a portion of the core bearing the bristles. The bristles have free ends that define an envelope surface, the envelope surface having at least one facet and at least one groove, the groove extending along at least half the length of the portion of the core bearing the bristles, and the envelope surface being configured such that at least one facet and at least one angular sector with a contour of circular overall shape in section are successively encountered on moving around the longitudinal axis of the brush, (Continued)

Figure 1:
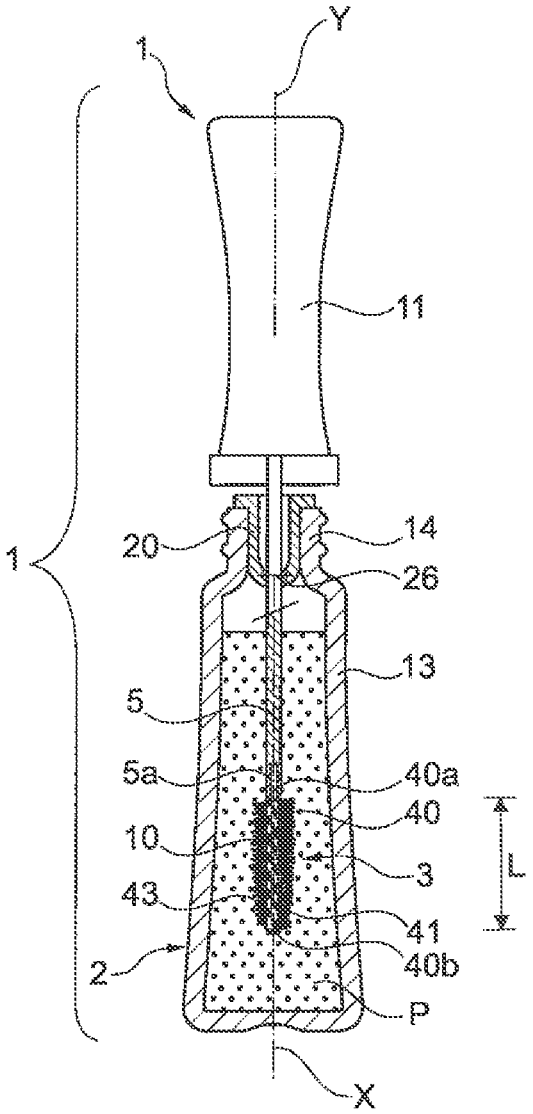

this angular sector comprising at least the groove, the groove having outer edges situated on the contour of circular overall shape of the angular sector.

12 Claims, 2 Drawing Sheets

(58) Field of Classification Search
CPC ..... A45D 34/046; A45D 40/267; A46B 2200/1053; A46B 9/021; A46B 2200/1046; A46B 2200/106; A46B 2200/108; A46B 2200/1086
USPC ..... 132/218
See application file for complete search history.

(56) References Cited

U.S. PATENT DOCUMENTS

| | | | | | |
|---|---|---|---|---|---|
| 5,595,198 | A | 1/1997 | Kemmerer | | |
| 5,918,994 | A * | 7/1999 | Gueret | A46B 9/021 | 401/122 |
| 6,279,583 | B1 * | 8/2001 | Neuner | A46B 3/18 | 132/218 |
| 6,371,130 | B1 * | 4/2002 | Vasas | A46B 9/021 | 132/218 |
| 7,254,860 | B2 * | 8/2007 | Dumler | A46B 9/021 | 15/207.2 |
| 9,033,605 | B2 * | 5/2015 | Gueret | A46B 9/021 | 401/129 |
| 2004/0134507 | A1 * | 7/2004 | Gueret | A46B 9/021 | 132/218 |
| 2004/0244809 | A1 * | 12/2004 | Gueret | A46D 1/00 | 132/218 |
| 2006/0056903 | A1 * | 3/2006 | Gueret | A45D 40/267 | 401/129 |
| 2007/0034223 | A1 * | 2/2007 | Dumler | A45D 40/262 | 132/218 |
| 2007/0079845 | A1 * | 4/2007 | Gueret | A45D 40/268 | 132/218 |
| 2008/0011317 | A1 * | 1/2008 | Malvar | A46B 9/028 | 132/218 |
| 2009/0114239 | A1 * | 5/2009 | Chen | A45D 40/262 | 132/218 |
| 2009/0241980 | A1 * | 10/2009 | Wyatt | A61K 8/11 | 132/218 |
| 2010/0083979 | A1 * | 4/2010 | Kim | A45D 40/264 | 132/218 |
| 2011/0114112 | A1 * | 5/2011 | Tsai | A46B 9/021 | 132/218 |
| 2015/0374114 | A1 * | 12/2015 | Wilson | A46D 1/04 | 300/21 |

FOREIGN PATENT DOCUMENTS

| | | | | |
|---|---|---|---|---|
| EP | 1050236 | A1 * | 11/2000 | A46B 9/021 |
| EP | 1236419 | A1 | 9/2002 | |
| EP | 1236420 | A1 | 9/2002 | |
| EP | 1236421 | A1 | 9/2002 | |
| EP | 2071977 | A1 * | 6/2009 | A46B 9/021 |
| FR | 2605505 | A1 | 4/1988 | |
| FR | 2715038 | A1 | 7/1995 | |
| FR | 2748913 | A1 | 11/1997 | |
| FR | 2890837 | A1 * | 3/2007 | A45D 34/045 |
| FR | 2945418 | A1 * | 11/2010 | A46B 9/021 |
| FR | 2973667 | A1 * | 10/2012 | A46B 9/021 |
| FR | 2991560 | A1 * | 12/2013 | A46B 9/021 |
| FR | 3013569 | A1 * | 5/2015 | A46B 3/16 |
| JP | 2015019814 | A | 2/2015 | |
| WO | WO-0207562 | A1 * | 1/2002 | A46B 9/021 |
| WO | WO-2011013098 | A1 * | 2/2011 | A45D 40/262 |
| WO | 2012140572 | A1 | 10/2012 | |
| WO | WO-2013034638 | A1 * | 3/2013 | A46B 9/021 |
| WO | WO-2013088418 | A1 * | 6/2013 | A46B 9/021 |

OTHER PUBLICATIONS

Gueret Jean-Louis, "FR_2991560_A1_I_translated" (Year: 2013).*
International Search Report for PCT/EP2017/079041 mailed Jan. 31, 2018 (3 pages).
Written Opinon of the International Searching Authority mailed Jan. 31, 2018 (6 pages).

* cited by examiner

BRUSH FOR APPLYING A PRODUCT TO THE EYELASHES AND/OR EYEBROWS

The present invention relates to brushes for applying a cosmetic product to the eyelashes or eyebrows, in particular a makeup or care product, for example mascara, and to packaging and application devices comprising such a brush.

A very large number of applicators, in which the brush comprises a core formed by two arms of a metal wire that are twisted together and grip bristles, are known. Since the bristles used are generally the same length, once the arms are twisted, the brush has an envelope surface in the form of a cylinder of revolution. Such a cylinder of revolution shape has limited effectiveness in terms of loading the eyelashes with product and separation.

Efforts have thus been made to give the envelope surface more complex shapes so as to form on the brush, after wiping, zones that are more heavily laden with product, making it possible to properly load the eyelashes, and zones that are less heavily laden or are laden little, these being usable to separate the eyelashes. Finding the shape that results in the optimum makeup result requires numerous tests, since many factors come into play.

In addition, it is economically advantageous for the brush to be able to be manufactured quickly and easily.

Numerous brushes have been proposed, with facets or notches machined in the longitudinal direction of the core.

The patent applications EP 0 792 603, EP 1 236 419, EP 1 236 420 and EP 1 236 421 disclose mascara brushes that can comprise facets which can be substantially flat and parallel to the core, and which have a generally oval contour. In these applications, the facets of one and the same brush are all identical.

The application FR 2 748 913 relates to a toothed brush, which, on account of the presence of the teeth, comprises longitudinal notches.

The subject of the patent application FR 2 715 038 is a mascara brush comprising a variable-width face, having non-rectilinear edges, and being able to define grooves.

The patent U.S. Pat. No. 5,595,198 relates to a mascara brush which comprises a notch and to which a twist has been applied in order to form a helical notch.

FR 2 605 505 describes a mascara brush comprising facets that form ridges between one another.

The subject of WO 2012/140572 is a mascara brush comprising non-flat faces that define non-rectilinear edges between one another.

There is a need to make it easier to apply makeup along the entire row of eyelashes, in particular at the corner of the eye.

There is also a need to improve brushes, in particular to benefit from brushes that are capable of satisfactorily making up the eyelashes and eyebrows, by providing a sufficient load of product and satisfactory combing.

The invention aims to meet all or some of these needs and therefore the subject thereof, independently or in combination with the above, according to one of its aspects, is a brush for applying a product to the eyelashes and/or eyebrows, comprising:

- a core, in particular a twisted core, that extends along a longitudinal axis X, and
- bristles that are held by the core in a portion of the core bearing the bristles, the bristles having free ends that define an envelope surface S, the envelope surface S having at least one facet and at least one groove, the groove extending along at least half the length of the portion of the core bearing the bristles, and the envelope surface S being configured such that at least one facet and at least one angular sector with a contour of circular overall shape in section are successively encountered on moving around the longitudinal axis X of the brush, this angular sector comprising at least the groove, said groove having outer edges situated on the contour of circular overall shape of the angular sector.

A "facet" is understood to be a cut in the envelope surface of the brush, delimited by visible edges. A facet is defined preferably by a generatrix extending in a plane perpendicular to the longitudinal axis of the core and progressing along a directrix, for example, coplanar with the longitudinal axis of the core. A facet may be planar or non-planar, having, for example, an outwardly concave or convex curvature. Such a curvature may depend on the rectilinear or curved form of the generatrix. In a variant, the curvature of the facet may vary, being, for example, wavy. A facet may be flat or convex. The facet(s) may promote the application and the transfer of the product onto the eyelashes or eyebrows.

A "groove" is understood to be a long, narrow recess made in the envelope surface of the brush. Within the meaning of the invention, a facet is different than a groove. A groove is long and narrow, having the form of a slot, whereas a facet is relatively wide and flattened. A groove is narrower than a facet. The grooves may allow a reserve of product to be formed.

By virtue of the presence of the grooves and facet(s), the invention thus makes it possible to form both reserves of product and application zones, thereby allowing the user to fully make up at least one eye, or even both eyes, without having to reload the brush with product.

The "outer edges" of a groove are understood to be the two furthest-apart edges of a groove when the latter is viewed in cross section, in a plane perpendicular to the longitudinal axis X of the core. The two outer edges of a groove are formed by the points of the groove that are furthest from the longitudinal axis X of the core. The two outer edges of a groove are spaced apart from one another for example by a distance of between 0.2 mm and 5 mm, better still between 1 mm and 3 mm, being for example 2 mm. In accordance with the invention, these two outer edges are situated over an angular sector with a contour of circular overall shape of the envelope surface S.

The outer edges of a groove may be rectilinear. They may be parallel to the longitudinal axis X of the core or inclined with respect to the latter. In a variant, the outer edges of a groove are curved, being for example outwardly concave or convex.

The brush may also comprise one or more grooves that extend along at least half the length of the portion of the core bearing the bristles.

The envelope surface may be of cylindrical overall shape. The overall shape of the envelope surface corresponds to the envelope surface minus the grooves and facets.

The envelope surface S may be at least partially in the form of a cylinder of revolution about the longitudinal axis X of the core. In cross section, the brush has at least one angular sector portion that does not have a groove. In other words, within the meaning of the invention, an angular sector comprising a groove also comprises an entirely circular portion, at least on one side of the groove, or on both sides of the groove, when the brush is viewed in cross section.

The envelope surface S may have at least one facet and at least two grooves, the two grooves extending along at least half the length of the portion of the core bearing the bristles.

The envelope surface S may be configured such that at least one facet and at least one angular sector with a contour of circular overall shape in section are successively encountered on moving around the longitudinal axis X of the brush, this angular sector comprising at least one of the two grooves, or both grooves, at least one of the grooves having outer edges situated on the contour of circular overall shape of the angular sector.

The brush may comprise at least two grooves extending along at least half the length of the portion of the core bearing the bristles, each of the two grooves having two outer edges situated on the contour of circular overall shape in section of the angular sector.

The brush may comprise at least two facets, or even three or more. In one embodiment, the brush comprises exactly two facets or exactly three facets.

The envelope surface may have, on moving around the longitudinal axis X of the core, an alternation of facets and angular sectors with a contour of circular overall shape in section comprising at least one groove.

The brush may comprise an angular sector with a contour of circular overall shape in section comprising a single groove. An angular sector may be delimited on both sides by two facets on moving around the longitudinal axis of the brush. The brush may comprise a single groove between two consecutive facets.

Moreover, in one embodiment, the brush comprises a single facet between two consecutive grooves.

In one embodiment, all of the angular sectors with a contour of circular overall shape in section of the brush each comprise at least one groove, or a single groove, or, in a variant, a plurality of grooves, for example two.

As seen along the longitudinal axis of the core in cross section, a facet may extend around the axis over an angular extent of less than 120°. This ensures that each facet is located on one side of the brush.

The brush may comprise at least two facets. These two facets may be symmetrical to one another, with respect to a plane containing the longitudinal axis of the core. In a variant, the brush may comprise three facets that may form a triangle when the brush is viewed in cross section. The facets may be distributed uniformly about the longitudinal axis of the core.

The facets may all be identical. At least two facets may be identical to one another.

In a variant, the envelope surface has at least one first facet and at least one second facet that are different from one another. On account of its different shape, the second facet may make it possible to provide different makeup characteristics.

"Facets that are different from one another" should be understood as meaning that the first and second facets differ from one another by way of at least one of their width, length, depth, distance from the core and inclination with respect to the core.

The second facet may be smaller than the first facet in terms of at least one of its dimensions, i.e. at least one of its width and/or its length and/or its depth is smaller than the width and/or length and/or depth of the first facet.

A facet may have a width which increases or decreases toward the proximal end of the portion of the core bearing the bristles, along at least a portion of the length of the facet, or even along the entire length of the facet.

A facet may have a width which decreases or increases toward the distal end of the portion of the core bearing the bristles, along at least a portion of the length of the facet.

A facet may extend along the entire length L of the portion of the core bearing the bristles, or only along a part thereof, for example along at least 50% of this length L, better still at least 60%, or even at least 70%. The facet may extend along less than 95% of the length L of the portion of the core bearing the bristles, or even along less than 90%, or even along less than 80%.

A facet may in particular extend as far as the proximal end of the portion of the core bearing the bristles.

A facet may extend parallel to the longitudinal axis X of the core. This means that the facet is made in a plane parallel to the longitudinal axis X of the core. It is possible for the envelope surface not to have facets that are not parallel to the longitudinal axis X of the core.

In a variant or in addition, the envelope surface may define at least one facet that extends longitudinally and in an inclined manner with respect to the longitudinal axis X of the core in the direction of the distal end. The term "inclined" should be understood as meaning that a general direction of the facet makes an angle with the longitudinal axis of the core. The generatrix defining the corresponding facet may in particular progress along a directrix that is not parallel to the longitudinal axis of the core, in particular rectilinear and at an angle thereto, or curved.

A facet may be inclined in the direction of the distal end of the core, i.e. the inclination of the facet with respect to the longitudinal axis of the core is such that the facet approaches the longitudinal axis of the core toward the distal end of the brush. All of the facets of the brush may be inclined in the direction of the distal end. It is possible for the brush not to have a facet inclined in the direction of the proximal end.

In a variant or in addition, a facet may be inclined in the direction of the proximal end of the core. This means that the inclination of the facet with respect to the longitudinal axis of the core is such that the facet approaches the longitudinal axis of the core toward the proximal end of the brush. All of the facets of the brush may be inclined in the direction of the proximal end. It is possible for the brush not to have a facet inclined in the direction of the distal end.

The envelope surface may have an overall shape that is at least partially frustoconical or ogival. This may make it possible for there to be zones on the envelope surface that are situated at different distances from the core and are thus wiped differently. The zones that are more loaded may be used to load the eyelashes with product and the zones that are less loaded may be used to separate the eyelashes.

The envelope surface may comprise a frustoconical distal portion with a cross section that becomes smaller toward the free end of the core. The frustoconical distal portion may extend along a length greater than one quarter of the length L of the portion of the core bearing the bristles, better still greater than one third of the length L of the portion of the core bearing the bristles, and even better still greater than half the length L of the portion of the core bearing the bristles.

The envelope surface may have at least one cross section with a shape that is not entirely polygonal, in particular a shape that is at least partially circular, in particular of circular shape on the distal-end side. "The distal-end side" should be understood as meaning that said at least one cross section is nearer to the distal end than to the proximal end of the portion of the core bearing the bristles; in other words, less than ½ L from the distal end of the portion of the core bearing the bristles and greater than ½ L from the proximal end of the portion of the core bearing the bristles, where L is the length of the portion of the core bearing the bristles measured between its proximal end and its distal end. Said at least one cross section may be less than one third, or even less than one quarter of the length L from the distal end of the portion of the core bearing the bristles. The length L may be between 15 mm and 45 mm, better still between 20 mm and 40 mm, for example between 25 mm and 35 mm.

It is possible for the brush not to have a distal end in the form of a point. It may be of not entirely prismatic shape, at least at its distal end.

The circular cross section may be provided at a point of the core situated less than ⅓ L from the distal end of the portion of the core bearing the bristles. The circular cross section may be provided at a point of the core located less than ¼ L from the distal end of the portion of the core bearing the bristles.

It is possible for the brush not to have any cross section of rectangular form, in particular at its distal end.

The brush may be chamfered at its proximal and/or distal end. In one exemplary embodiment, the brush is chamfered at its distal and proximal ends.

The envelope surface, apart from the facets and the grooves, may be cylindrical. The envelope surface, apart from the facets and the grooves, may be a surface of revolution.

The envelope surface may be symmetrical with respect to the longitudinal axis X of the core. In a variant, the envelope surface does not exhibit axial symmetry.

The core of the brush may be rectilinear or curved. It is preferably rectilinear.

The core may comprise a portion bearing bristles that has a proximal end intended to be fixed to the stem of the applicator and a distal end.

The distal end of the core may be situated on the longitudinal axis Y of the stem to which the core is attached.

At its opposite end from the brush, the stem may be fixed to a closure cap of a container.

Preferably, the core is a twisted core. The expression "twisted core" should be understood as meaning a core formed by twisting together two arms of a metal wire, in a conventional manner, the bristles being clamped between the arms.

A further subject of the invention, independently or in combination with the above, is a brush for applying a product to the eyelashes and/or eyebrows, comprising:

- a core, in particular a twisted core, that extends along a longitudinal axis X, and
- bristles that are held by the core in a portion of the core bearing the bristles, the bristles having free ends that define an envelope surface S, the envelope surface S having at least one facet and at least two grooves, the two grooves extending along at least half the length of the portion of the core bearing the bristles, and the envelope surface S being configured such that at least one facet and at least one angular sector with a contour of circular overall shape in section are successively encountered on moving around the longitudinal axis X of the brush, this angular sector comprising at least one of the two grooves, or both grooves, at least one of the grooves having outer edges situated on the contour of circular overall shape of the angular sector.

Device

A further subject of the invention is a packaging and application device comprising:

- a container containing a product to be applied, and
- a brush according to the invention, as defined above.

The container may be provided with a wiping member for removing the excess product present on the stem and on the brush. This wiping member comprises, for example, a lip made from an elastomeric material, defining a wiping orifice of preferably circular cross section, the diameter of which corresponds substantially to that of the stem.

A further subject of the invention, according to another of its aspects, independently or in combination with the above, is a packaging and application device comprising a container containing a product to be applied, and a brush for applying a product to the eyelashes and/or eyebrows, the brush comprising:

- a core, in particular a twisted core, that extends along a longitudinal axis X, and
- bristles that are held by the core in a portion of the core bearing the bristles, the bristles having free ends that define an envelope surface S, the envelope surface S having at least one facet and at least one groove, said groove extending along at least half the length of the portion of the core bearing the bristles, and the envelope surface S being configured such that at least one facet and at least one angular sector of circular overall shape are successively encountered on moving around the longitudinal axis X of the brush, said angular sector comprising at least said groove, the groove having outer edges situated on the contour of circular overall shape of the angular sector.

Manufacturing Method

A further subject of the invention is a method for manufacturing a brush according to the invention, comprising the steps consisting in:

- producing a brush blank, in particular a twisted-core brush blank, in particular having an envelope surface with a cylindrical shape, preferably a rotationally symmetrical shape,
- faceting the bristles so as to obtain groove(s) and facet(s) according to the invention.

The facet(s) can be formed by moving a cutting tool both along an axis parallel to the longitudinal axis of the core and along an axis perpendicular to the longitudinal axis of the core.

In a variant or in addition, the facet(s) can be formed by moving a cutting tool about an axis perpendicular to the longitudinal axis of the core, in particular an axis parallel to the facet.

The cutting tool preferably has an axis of rotation parallel or perpendicular to the facet.

Makeup Method

A further subject of the invention is a makeup method, wherein a brush as defined above is loaded with product, in particular with cosmetic, makeup or care product, and then the product is applied to the surface to be made up, in particular the eyelashes or the eyebrows, preferably by performing a rotational movement of the brush with respect to the surface to be made up, in particular with respect to the row of eyelashes or eyebrows. The rotational movement is carried out about the longitudinal axis X of the core.

The rotational movement of the brush makes it possible to bring the surface to be made up into contact with a zone of the brush that is very heavily laden with product, in particular a groove, and then with a zone that promotes application, in particular a facet.

DETAILED DESCRIPTION

Figure 2:
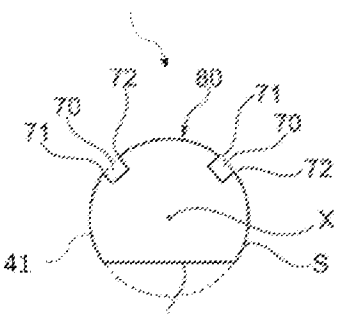

The invention may be understood better from reading the following detailed description of nonlimiting illustrative embodiments thereof and from studying the appended drawing, in which:

FIG. 1 shows an example of a packaging and application device according to the invention, in schematic and partial longitudinal section, FIG. 2 is a cross section of an example of a brush according to the invention, and FIGS. 3*a* to 3*d* are views similar to FIG. 2 of variant embodiments.

In the rest of the description, identical elements or elements having identical functions bear the same reference signs. Their description is not repeated for each of the figures, only the main differences between the embodiments being mentioned.

The packaging and application device 1 shown in FIG. 1 comprises a container 2 containing a product P to be applied to the eyelashes or eyebrows and an applicator 3 which may be fixed removably to the container 2 in the example in question. The product P comprises, for example, one or more pigments, in particular an iron oxide. It is, for example, a mascara.

The applicator 3 comprises a stem 5, of longitudinal axis Y, which is provided at a distal end 5*a* with a brush 10 according to the invention and at the other end with a gripping member 11, which likewise constitutes a cap for closing the container 2 in a sealed manner. As can be seen in particular in FIG. 1, the latter has a body 13 which is provided at the top with a threaded neck 14 onto which the gripping member 11 can be screwed in order to close the container 2 in a sealed manner. In a variant, the applicator may be fixed to the container in some other way.

The neck 14 may accommodate, as illustrated, a wiping member 20 which is for example inserted into the neck 14. This wiping member 20 comprises a lip 26 that defines a wiping orifice having a diameter adapted to that of the stem 5.

The brush 10 may be fixed, in a conventional manner, in a seat provided at the distal end 5*a* of the stem 5, which is advantageously made of a thermoplastic material. The brush 10 comprises a twisted metal core 40 comprising a portion 43 bearing bristles 41. The core is fixed at a proximal end 40*a* in the corresponding seat of the stem 5, via a portion without bristles that may have a length of around 8 mm. The portion 43 of the core bearing the bristles has a free distal end 40*b*.

As illustrated in FIG. 2, the free ends of the bristles 41 define an envelope surface S of the brush 10. The bristles 41 extend along a length L of the core of preferably between 25 mm and 35 mm, for example equal to 30 mm.

The core 40 is formed conventionally by two arms of a metal wire folded in a U-shape, the bristles 41 being held between the turns of the core 40. The diameter of the metal wire is for example between 0.1 and 1 mm. The diameter of the bristles is for example between 0.06 and 0.35 mm.

The maximum radius of the envelope surface S, corresponding to the radius of the smallest cylinder of revolution in which the brush is inscribed, is between 3 mm and 6 mm, for example 4.5 mm.

The core 40 of the brush 10 is rectilinear in the example in question, extending along a rectilinear longitudinal axis X. In a variant, it is curved.

As illustrated in FIG. 2, the envelope surface S comprises a facet 60 which extends, as illustrated, parallel to the longitudinal axis X of the core.

The envelope surface S also has two grooves 70, the latter extending along at least half the length of the portion of the core bearing the bristles. The two grooves 70 are made in a sector 80 of the envelope surface S which has an external contour of circular overall shape in cross section, that is to say circular apart from the grooves 70.

Thus, at least one facet 60 and at least one sector 80 comprising the two abovementioned grooves 70 are encountered on moving around the longitudinal axis X of the brush.

The grooves 70 have two outer edges 71 and 72 that belong to the circular contour of the envelope surface S in the sector 80.

In this example, the sector 80 comprises two grooves 70. Thus, the brush comprises a single facet between two consecutive grooves. The facet 60 extends about the axis X over an angular extent of around 120°, and the sector 80 extends about the axis X over an angular extent of around 240°. The two grooves 70 are disposed substantially at 90° to one another.

Figure 3A:
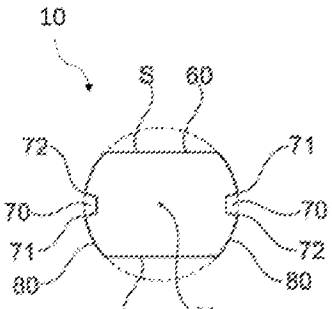

In the variant embodiment illustrated in FIG. 3*a*, the two grooves 70 are disposed substantially at 180° to one another, and the brush comprises two facets 60 disposed on either side of the longitudinal axis X of the core, which are symmetrical to one another, with respect to a plane containing the longitudinal axis X of the core. The brush 10 comprises two sectors 80 which are likewise disposed on either side of the longitudinal axis X of the core and which are symmetrical to one another, with respect to a plane containing the longitudinal axis X of the core, each one comprising a groove 70.

Figure 3B:
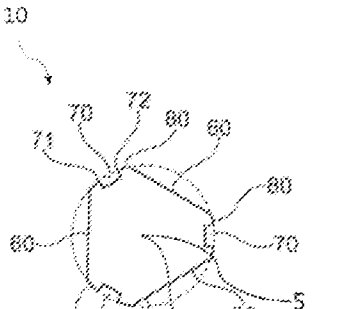

In the variant embodiment illustrated in FIG. 3*b*, the brush 10 comprises three facets 60, which form a triangle when the brush is viewed in cross section. Between two consecutive facets 60, the brush comprises a sector 80 comprising a groove 70, such that the brush has a total of three angular sectors 80 and three grooves 70 distributed regularly around the core. In the example in question, the three facets 60 extend longitudinally and are flat, each extending in a plane parallel to the longitudinal axis X of the core.

Figure 3C:
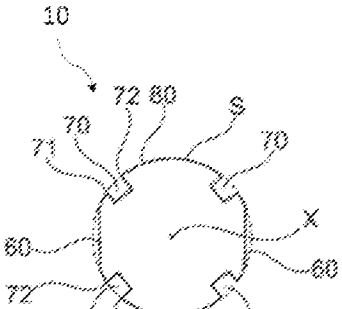

In the variant embodiment illustrated in FIG. 3*c*, the brush 10 comprises four grooves 70 that are distributed regularly around the core and disposed substantially at 90° to one another, and two facets 60. Thus, the brush 10 comprises two sectors 80 that each comprise two grooves 70.

Figure 3D:
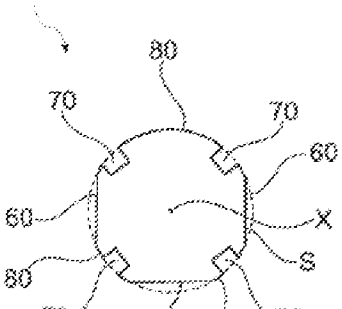

In the example in FIG. 3*d*, the brush 10 likewise comprises four grooves 70 that are distributed regularly around the core and disposed substantially at 90° to one another, but with three facets 60. Thus, the brush 10 comprises a single sector 80 comprising two grooves 70, and two sectors 80 that each comprise a groove 70.

Of course, further combinations of grooves and facets are possible without departing from the scope of the present invention. Generally, the envelope surface can comprise a different number of facets and grooves and it is possible for the latter not to be identical to one another and/or distributed regularly around the core 40.

The ends 40*a* and 40*b* of the envelope surface S may be chamfered. This can make it easier for the brush 3 to pass through the wiping member 20. The chamfer at the distal end and the chamfer at the proximal end may be different. The chamfer at the distal end may, in particular, be less inclined than that at the proximal end. In a variant, it is possible for the brush not to have such end chamfers.

The invention is not limited to the exemplary embodiments which have just been described, the characteristics of which may be combined with one another as parts of variants which are not illustrated.

The invention claimed is:

1. A brush for applying a product to the eyelashes and/or eyebrows, comprising:

a core, that extends along a longitudinal axis, and bristles that are held by the core in a portion of the core bearing the bristles, the bristles having free ends that define an envelope surface, the envelope surface, apart from facet(s) and groove(s), being cylindrical, wherein the envelope surface has:

at least two facets extending along at least half the length of the portion of the core bearing the bristles;

at least two angular sectors with a contour of circular overall shape in section of the envelope surface; and at least two grooves, each having outer edges situated on the contour of circular overall shape of one of the at least two angular sectors, the at least two grooves extending along at least half the length of the portion of the core bearing the bristles, the at least two grooves being narrower than the at least two facets, the at least two facets being made by cutting the envelope surface and being delimited by visible edges, and wherein the at least two angular sectors, the at least two grooves and the at least two facets are configured such that the envelope surface has on moving around the longitudinal axis of the core, an alternation of facet(s) and angular sector(s), each angular sector being delimited on both sides by the at least two facets on moving around the longitudinal axis of the brush, and the at least two grooves arranged such that all of the angular sectors of the brush each comprising one or two grooves.

2. The brush as claimed in claim 1, wherein at least one of the at least two angular sectors with a contour of circular overall shape in section of the envelope surface comprises an angular sector with a contour of circular overall shape in section of the envelope surface comprising a single groove.

3. The brush as claimed in claim 1, wherein the at least two facets and the at least two grooves are configured such that a single facet of the least two facets is comprised between two consecutive grooves of the least two grooves.

4. The brush as claimed in claim 1, wherein the two outer edges of each of the at least two grooves are spaced apart from one another by a distance of between 0.2 mm and 5 mm.

5. The brush as claimed in claim 1, wherein, as seen from the longitudinal axis of the core in cross section, at least one facet of the at least two facets extends around the axis over an angular extent of less than 120°.

6. The brush as claimed in claim 1, wherein at least one facet of the at least two facets is flat or convex.

7. The brush as claimed in claim 1, the core comprising a distal end which is situated on the longitudinal axis of a stem to which the core is attached.

8. The brush as claimed in claim 1, the core having a proximal end intended to be fixed to a stem.

9. A packaging and application device comprising a container containing a product to be applied, and a brush as claimed in claim 1.

10. A brush for applying a product to the eyelashes and/or eyebrows, comprising:

a core, that extends along a longitudinal axis, and bristles that are held by the core in a portion of the core bearing the bristles, the bristles having free ends that define an envelope surface, the envelop surface apart from the facet(s) and groove(s), being cylindrical;

wherein the envelope surface has:

at least two facets extending along at least half the length of the portion of the core bearing the bristles;

at least two angular sectors with a contour of circular overall shape in section of the envelope surface; and at least two grooves each having outer edges situated on the contour of circular overall shape of one of the at least two angular sectors, the at least two grooves extending along at least half the length of the portion of the core bearing the bristles, the at least two facets being made by cutting the envelope surface and being delimited by visible edges, and wherein the envelope surface is configured such that on moving around the longitudinal axis of the core, an alternation of facet(s) and angular sector(s), each angular sector being delimited on both sides by the at least two facets on moving around the longitudinal axis of the brush, the at least two grooves arranged such that each angular sector of the at least two angular sectors comprising a single groove of the at least two grooves and at least one of the at least two angular sectors comprising a portion not having said single groove.

11. A brush for applying a product to the eyelashes and/or eyebrows, comprising:

a core, that extends along a longitudinal axis, and bristles that are held by the core in a portion of the core bearing the bristles, the bristles having free ends that define an envelope surface, the envelope surface apart from the facet(s) and groove(s), being cylindrical;

wherein the envelope surface has:

at least two facets extending along at least half the length of the portion of the core bearing the bristles, at least two angular sectors with a contour of circular overall shape in section of the envelope surface, and at least two grooves, each having outer edges situated on the contour of the circular overall shape of one of the at least two angular sectors, the at least two grooves extending along at least half the length of the portion of the core bearing the bristles, the at least two grooves being narrower than the at least two facets, the at least two facets being made by cutting the envelope surface and being delimited by visible edges, and wherein the brush comprises an alternation of facets and angular sectors with a contour of circular overall shape in section, the at least two grooves arranged such that each of the at least two angular sectors comprising two grooves, each of the at least two angular sectors being delimited on both sides by the at least two facets on moving around the longitudinal axis of the brush.

12. The brush as claimed in claim 11, wherein the at least two angular sectors comprise all of the angular sectors with a contour of circular overall shape in section of the brush.

* * * * *